US006078873A

United States Patent [19]

Shutty et al.

[11] Patent Number: 6,078,873

[45] Date of Patent: Jun. 20, 2000

[54] METHOD AND APPARATUS FOR REAL-TIME DATA STAMPING VIA DATALINK AND VOLATILE ECM TIMER/CLOCK

[75] Inventors: John V. Shutty; Tom J. Milvert; Dan R. Baker; Mitchell P. Vogan, all of Columbus, Ind.

[73] Assignee: Cummins Engine Company, Inc., Columbus, Ind.

[21] Appl. No.: 08/942,876

[22] Filed: Oct. 2, 1997

[51] Int. Cl.[7] ..... G04F 7/00

[52] U.S. Cl. ..... 702/89; 702/177; 702/178; 702/187

[58] Field of Search ..... 702/89, 187, 186, 702/176, 177, 178; 395/185.08, 551, 555; 371/22.36, 27.7; 73/1.42

[56] References Cited

U.S. PATENT DOCUMENTS

| | | | |
|---|---|---|---|
| 4,216,527 | 8/1980 | Emerson et al. | 364/483 |
| 4,234,926 | 11/1980 | Wallace et al. | 364/551 |
| 4,348,730 | 9/1982 | Emerson et al. | 364/483 |
| 4,602,340 | 7/1986 | Appelberg | 364/492 |
| 4,622,640 | 11/1986 | Shimamura et al. | 364/483 |
| 4,916,625 | 4/1990 | Davidson et al. | 364/470 |
| 5,027,297 | 6/1991 | Garitty et al. | 364/569 |
| 5,136,643 | 8/1992 | Fischer | 380/23 |
| 5,150,407 | 9/1992 | Chan | 380/4 |
| 5,285,496 | 2/1994 | Frank et al. | 380/9 |
| 5,363,377 | 11/1994 | Sharpe | 370/100.1 |
| 5,388,255 | 2/1995 | Pytlik et al. | 395/600 |
| 5,437,163 | 8/1995 | Jurewicz et al. | 62/126 |
| 5,461,675 | 10/1995 | Diehl et al. | 380/23 |
| 5,563,607 | 10/1996 | Loomis et al. | 342/357 |
| 5,590,116 | 12/1996 | Zhang | 370/253 |
| 5,602,992 | 2/1997 | Danneels | 395/200.19 |

*Primary Examiner*—Marc S. Hoff
*Assistant Examiner*—Hien Vo
*Attorney, Agent, or Firm*—Woodard, Emhardt, Naughton, Moriarity & McNett Patents Trademarks Attorneys

[57] ABSTRACT

A method and apparatus for real-time data stamping via datalink and volatile ECM timer/clock. An engine control module (ECM) includes a volatile time-keeping mechanism, such as time-keeping software code inserted into the ECM software, which is capable of keeping track of elapsed time as long as the ECM microprocessor is powered. The ECM initially sets the volatile time-keeping mechanism with real time (RT) at ECM power up by retrieving the current RT over an attached datalink from a non-volatile RT clock (i.e. a clock that keeps track of time even during ECM power down). Thereafter, the ECM microprocessor may time stamp stored data using RT from the volatile time-keeping mechanism. The present invention thus precludes the need to provide a dedicated RT clock for the ECM, or the need for the ECM to request RT over the datalink every time the ECM wishes to time stamp data to be stored.

9 Claims, 3 Drawing Sheets

METHOD AND APPARATUS FOR REAL-TIME DATA STAMPING VIA DATALINK AND VOLATILE ECM TIMER/CLOCK

TECHNICAL FIELD OF THE INVENTION

The present invention generally relates to engine control modules and, more particularly to a method and apparatus for real-time data stamping via datalink and volatile ECM timer/clock.

BACKGROUND OF THE INVENTION

In the field of internal combustion engines, such as those used to power automobiles and trucks, for example, it is common practice to provide some form of electronic engine control module (ECM). Such an ECM may be a single, centralized unit or it may be part of a network of other vehicle controllers coupled by one or more datalinks for sharing of information.

An ECM typically provides electronic control signals to various engine components in order to regulate the operating point of the engine. For example, a typical ECM might provide control signals to the engine fuel injection system and to the electronic ignition system in order to control engine fueling and combustion.

ECMs are also used to measure and collect information about the engine and/or vehicle. For example, most engine control signals are generated using some form of input from an engine parameter measurement device. Therefore, a fuel injection control signal might be formulated by using a signal from a mass air flow sensor as an input, for example. A typical ECM will monitor many such engine measurement transducers in order to product its various control signal outputs.

In addition to making measurements to be used as inputs for generation of ECM control signals, a typical ECM will also measure and store many pieces of data for later use. For example, it is common for the ECM to store the date and time that maintenance was performed or that a calibration value was changed using a service tool. Additional types of information stored by the ECM include recording of unusual occurrences, such as recording each panic stop made by the driver of the vehicle, the highest speed attained by the vehicle, and the highest temperature experienced by the engine coolant, as well as fault information, such as the values of various engine temperatures and pressures when they are out of tolerance, etc. When the ECM stores each of these pieces of information, it is desirable to "stamp" (i.e. associate) each piece of information with real-time (RT) data. In other words, each piece of stored data has associated with it a record that indicates the date and time relevant to the data (usually either when the data was created, stored and/or when the event occurred which caused the creation of the data).

Referring to FIG. 1, there is illustrated a schematic block diagram of a typical prior art apparatus for providing RT stamping of information within an ECM, indicated generally at 10. The ECM is implemented as a microprocessor 12 having a dedicated real-time clock 14 hard wired thereto. The RT clock 14 is non-volatile, meaning that it keeps track of the current real clock time and/or the current date and this information is retained under normal operating conditions, such as vehicle key-off or shut down of the microprocessor 12. Because RT is always available to the microprocessor 12 from the RT clock 14 via the hard wired line 16, the microprocessor 12 is able to perform RT stamping of any data which is stored by the microprocessor 12. For example, data records 18 may be stored by the microprocessor 12 into an associated memory (not shown), wherein each of the data records 18 comprises data 20 gathered by the microprocessor 12 through data input lines (not shown), as well as RT information 22 associated with each piece of data 20.

Although the prior art ECM 10 provides a convenient method for deriving the RT information required for RT stamping of the data 20, the provision of an RT clock 14 with each ECM or controller is relatively expensive, especially when each engine might contain several controllers performing different functions. An alternative prior art strategy is illustrated in FIG. 2, and indicated generally at 30. In the ECM 30, the RT clock 14 is not hard wired to the microprocessor 12, but is instead accessed by the microprocessor 12 through the datalink 32. By providing access to the RT clock 14 via the datalink 32, several different ECMs may share a single RT clock 14. This greatly reduces the system cost.

In the ECM 30, the data records 18 are stored in the same format as in the ECM 10, comprising data 20 and RT stamp 22. However, every time the microprocessor 12 requires an RT stamp 22, it must request the RT information from the RT clock 14 over the datalink 32. Because the microprocessor 12 must retrieve the RT information whenever it is needed over the datalink 32, this alternative design has several drawbacks: 1) it requires a fairly high frequency access of the datalink 32, increasing datalink and microprocessor loading, 2) a time latency is introduced when retrieving RT, because a not insignificant amount of time is required to request RT over the datalink 32 and then transmit RT back to the microprocessor, 3) implementation of this configuration into an RT embedded system can be difficult due to timing constraints.

There is therefore a need for a method and apparatus for providing RT information to an ECM which is cost effective and which avoids the problems associated with prior art designs. The present invention is directed toward meeting this need.

SUMMARY OF THE INVENTION

The present invention relates to a method and apparatus for real-time data stamping via datalink and volatile ECM timer/clock. An engine control module (ECM) includes a volatile time-keeping mechanism, such as time-keeping software code inserted into the ECM software, which is capable of keeping track of elapsed time as long as the ECM microprocessor is powered. The ECM initially sets the volatile time-keeping mechanism with real time (RT) at ECM power up by retrieving the current RT over an attached datalink from a non-volatile RT clock (i.e. a clock that keeps track of time even during ECM power down). Thereafter, the ECM microprocessor may time stamp stored data using RT from the volatile time-keeping mechanism. The present invention thus precludes the need to provide a dedicated RT clock for the ECM, or the need for the ECM to request RT over the datalink every time the ECM wishes to time stamp data to be stored.

In one form of the invention, an apparatus for real-time data stamping is disclosed, comprising an engine control module including a volatile time-keeping mechanism; a non-volatile real-time clock; and a datalink coupling the engine control module to the real-time clock; wherein the engine control module is operative to retrieve real-time from the real-time clock over the datalink at power-up of the engine module; and wherein the engine control module is operative to set the volatile time-keeping mechanism using the real-time retrieved from the real-time clock, such that the engine control module may thereafter perform real-time data stamping using the volatile time-keeping mechanism.

In another form of the invention, a method for real-time data-stamping is disclosed, comprising: a) providing an engine control module including a volatile time-keeping mechanism; b) providing a non-volatile real-time clock; c) providing a datalink coupling the engine control module to the real-time clock; d) causing the engine control module to retrieve real-time from the real-time clock over the datalink at power-up of the engine control module; e) setting the volatile time-keeping mechanism using the real-time retrieved from the real-time clock; and f) performing real-time data stamping using the volatile time-keeping mechanism.

In another form of the invention, a method for real-time data stamping is disclosed, including the steps of: a) providing an engine control module including a volatile time-keeping mechanism; b) providing a non-volatile real-time clock; c) providing a datalink coupling the engine control module to the real-time clock; d) setting the volatile time-keeping mechanism to zero at power-up of the engine control module, such that the volatile time-keeping mechanism will measure time since power-up; e) causing the engine control module to store measurement data together with a value of the volatile time-keeping mechanism; f) causing the engine control module to retrieve current real-time from the real-time clock over the datalink prior to power-down of the engine control module; g) calculating the real-time at which the measurement data was stored at step (e), using the value of the volatile time-keeping mechanism stored with the measurement data, the current value of the volatile time-keeping mechanism, and the current real-time; and h) storing with the measurement data the calculated real-time at which the measurement data was stored at step (e).

In yet another form of the invention, a method is disclosed for real-time data stamping including the steps of: a) providing an engine control module including a volatile time-keeping mechanism; b) providing a non-volatile real-time clock; c) providing a datalink coupling the engine control module to the real-time clock; d) setting the volatile time-keeping mechanism to zero at power-up of the engine control module, such that the volatile time-keeping mechanism will measure time since power-up; e) causing the engine control module to store measurement data together with a value of the volatile time-keeping mechanism; f) causing the engine control module to retrieve current real-time from the real-time clock over the datalink prior to power-down of the engine control module; g) causing the engine control module to store the current real-time and a corresponding current value of the volatile time-keeping mechanism; and h) wherein the real-time at which the measurement data was stored at step (e) may be calculated using the value of the volatile time-keeping mechanism stored with the measurement data, the current value of the volatile time-keeping mechanism, and the current real-time.

DETAILED DESCRIPTION OF THE PREFERRED EMBODIMENT

Figure 1:
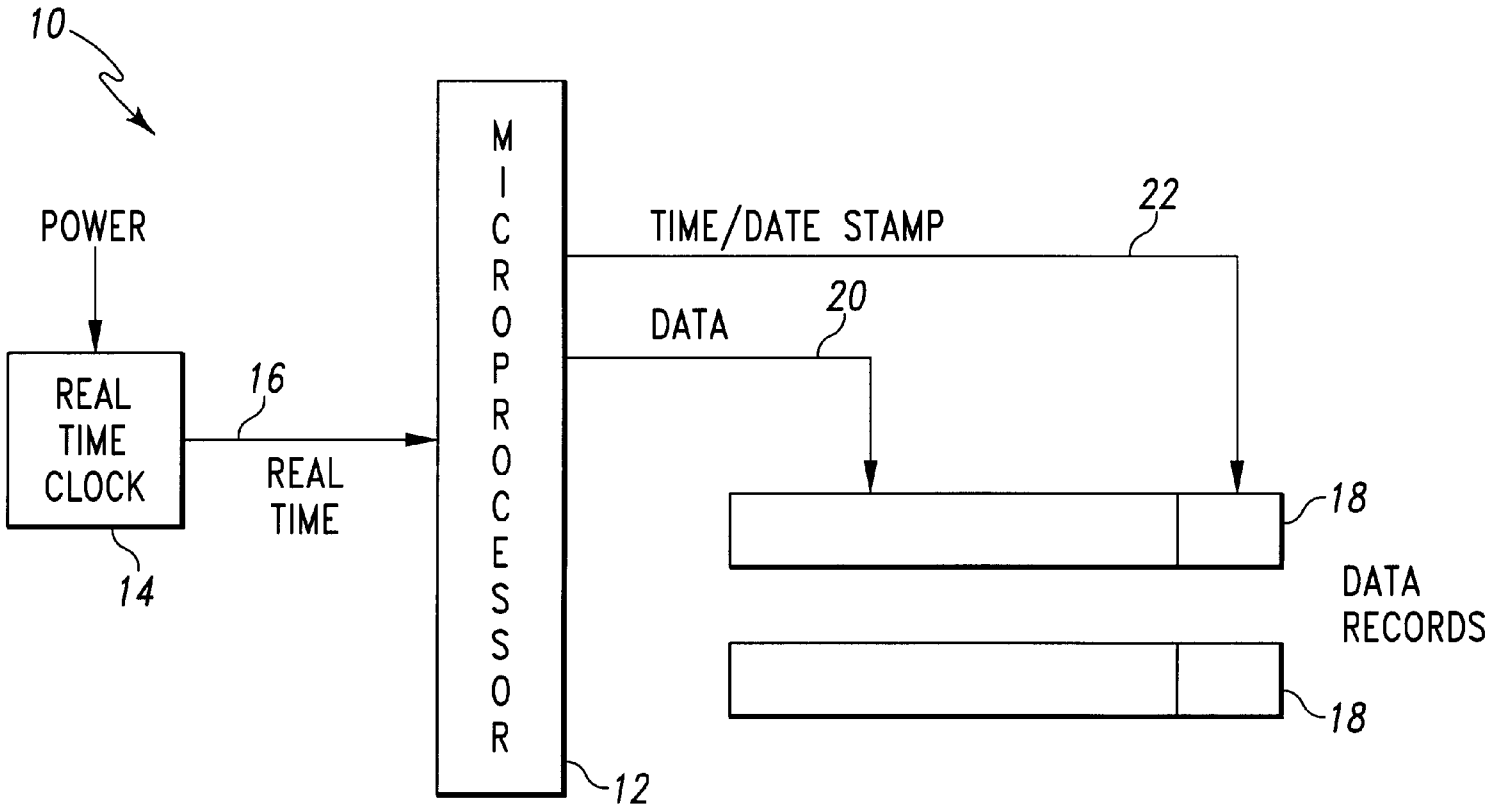
Fig. 1 (Prior Art)
FIG. 1 is a schematic block diagram of a first embodiment prior art ECM having a hard wired RT clock.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
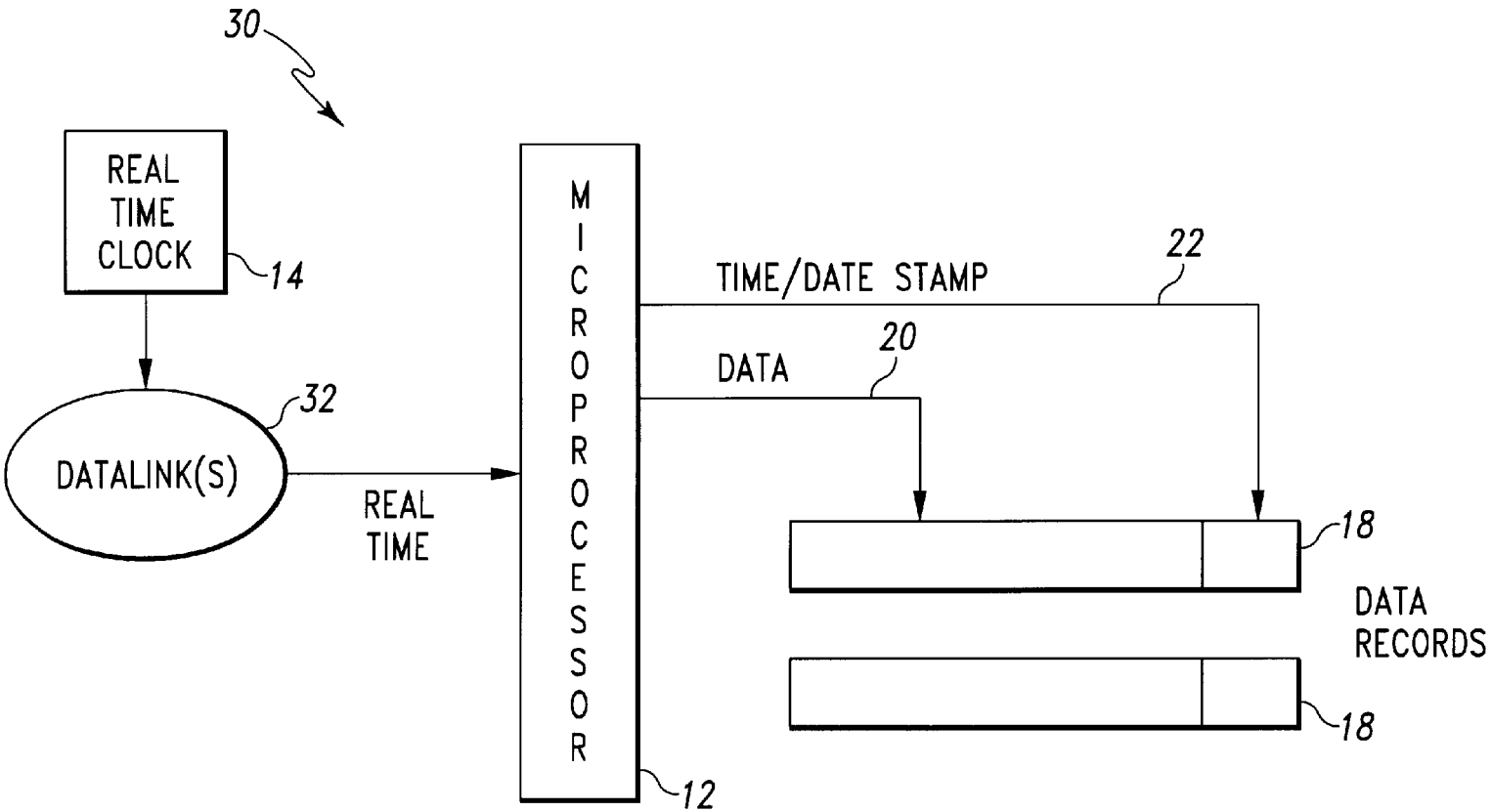
Fig. 2 (Prior Art)
FIG. 2 is a schematic block diagram of a second embodiment prior art ECM having RT clock access through a datalink.
Figure 3:
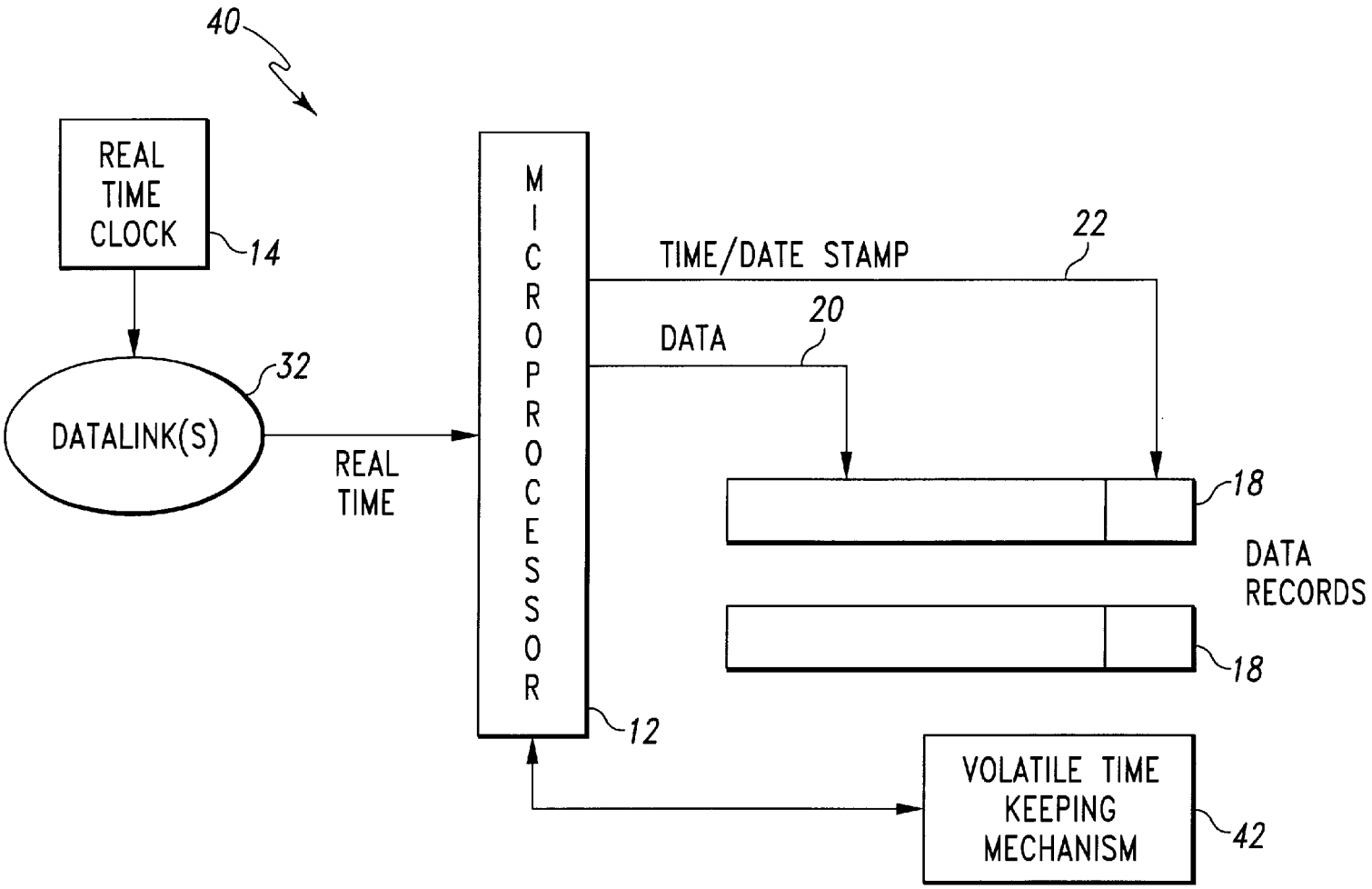
FIG. 3 is a schematic block diagram of a preferred embodiment of the present invention, in which an ECM has access to an RT clock over a datalink and also incorporates a volatile time-keeping mechanism within the ECM.

A preferred embodiment of the present invention is illustrated schematically at FIG. 3, and indicated generally at 40. The ECM 40 of the present invention is similar to the ECM 30 of FIG. 2 in that the microprocessor 12 does not have a hard wired connection to the RT clock 14. Instead, RT information from the RT clock 14 is provided to the microprocessor 12 via the datalink 32. However, the ECM 40 further includes a volatile time-keeping mechanism 42 coupled to the microprocessor 12. The time keeping mechanism 42 is volatile, indicating that information stored in the mechanism 42 will be lost on a periodic basis (such as shut down of the ECM 40). For example, the volatile time keeping mechanism 42 may be implemented by simply inserting time-keeping software code into the ECM 40 run-time software executed by the microprocessor 12.

Upon power-up of the microprocessor 12, RT is requested from the RT clock 14 via the datalink 32. This RT data is then used to set the volatile time-keeping mechanism 42 to the current RT. Thereafter, the volatile time-keeping mechanism 42 will keep track of RT so long as there is no vehicle key-off or shut down of the microprocessor 12. Therefore, by using the volatile time-keeping mechanism 42, the microprocessor can establish RT from the RT clock 14 over the datalink 32 and thereafter have RT data available without further access to the datalink 32. Such a configuration makes it much easier for the microprocessor 12 to access RT data (there is no access of the datalink 32 required), however the expense of incorporating the RT clock 14 into the ECM 40 is avoided. Of course, because the time-keeping mechanism 42 is volatile, it will need to be reset by the microprocessor 12 after every loss of power (which would cause the volatile time-keeping mechanism 42 to lose track of RT).

Because of the nature of the volatile time keeping mechanism 42, its ability to keep track of RT will generally be much less precise than the RT clock 14. It therefore may be desirable, depending upon the precision required in the RT stamp 22, to periodically recalibrate the volatile time-keeping mechanism 42 by requesting RT from the RT clock 14 over the datalink 32. Such low frequency requests for RT over the datalink 32 would not place any appreciable burden upon either the microprocessor 12 or the datalink 32, and would ensure continued synchronization between the RT clock 14 and the volatile time-keeping mechanism 42 over potentially long periods of time.

A second alternative would be to start the volatile time-keeping mechanism 42 at zero upon power up of the microprocessor 12 (i.e. do not calibrate the volatile time-keeping mechanism 42 to the RT clock 14 at start up). The RT stamp 22 would then simply consist of the delta time since the last power up of the ECM 40. It would then be necessary to request RT from the RT clock 14 via the datalink 32 at some point before shutting down the volatile time-keeping mechanism 42. Receipt of the current RT data would then allow the microprocessor 12 to back-calculate the appropriate RT stamps for each of the data records 18 based upon the stored delta times. The microprocessor 12 could then modify the stored delta times with actual RT stamps. Alternatively, a microprocessor 12 could simply store information which could allow another device to back-calculate the RT time stamp data at a later time. Such stored information might consist of a single RT time stamp and the delta time associated therewith.

Regardless of the method used to operate the ECM 40, the ECM 40 exhibits the significant advantage of requiring only low frequency retrieval of RT over the datalink 32, with the use of a volatile time-keeping mechanism 42 within the ECM 40. In this way, it is not necessary to provide a dedicated RT clock 14 for the ECM 40, and it is also not necessary for the ECM 40 to retrieve RT over the datalink 42 every time it is desired to RT stamp recorded data. Significant economies are therefore realized by the ECM 40 over prior art designs.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for real-time data stamping, comprising:

an engine control module including a volatile time-keeping mechanism;

a non-volatile real-time clock; and a datalink coupling the engine control module to the real-time clock;

wherein the engine control module is operative to retrieve real-time from the real-time clock over the datalink at power-up of the engine module; and wherein the engine control module is operative to set the volatile time-keeping mechanism using the real-time retrieved from the real-time clock, such that the engine control module may thereafter perform real-time data stamping using the volatile time-keeping mechanism.

2. The apparatus of claim 1, wherein the engine control module is a microprocessor.

3. The apparatus of claim 1, wherein the volatile time-keeping mechanism comprises software code executed by the engine control module.

4. The apparatus of claim 1, wherein the engine control module is operative to periodically retrieve real-time from the real-time clock over the datalink in order to recalibrate the volatile time-keeping mechanism.

5. A method for real-time data-stamping, comprising the steps of:

a) providing an engine control module including a volatile time-keeping mechanism;

b) providing a non-volatile real-time clock;

c) providing a datalink coupling the engine control module to the real-time clock;

d) causing the engine control module to retrieve real-time from the real-time clock over the datalink at power-up of the engine control module;

e) setting the volatile time-keeping mechanism using the real-time retrieved from the real-time clock; and f) performing real-time data stamping using the volatile time-keeping mechanism.

6. The method of claim 5, further comprising the steps of:

g) periodically causing the engine control module to retrieve an updated real-time from the real-time clock; and h) recalibrating the volatile time-keeping mechanism using the updated real-time.

7. A method for real-time data-stamping comprising the steps of:

a) providing an engine control module including a volatile time-keeping mechanism;

b) providing a non-volatile real-time clock;

c) providing a datalink coupling the engine control module to the real-time clock;

d) setting the volatile time-keeping mechanism to zero at power-up of the engine control module, such that the volatile time-keeping mechanism will measure time since power-up;

e) causing the engine control module to store measurement data together with a value of the volatile time-keeping mechanism;

f) causing the engine control module to retrieve current real-time from the real-time clock over the datalink prior to power-down of the engine control module;

g) calculating the real-time at which the measurement data was stored at step (e), using the value of the volatile time-keeping mechanism stored with the measurement data, a current value of the volatile time-keeping mechanism, and the current real-time; and h) storing with the measurement data the calculated real-time at which the measurement data was stored at step (e).

8. The method of claim 7, wherein at step (h) the calculated real-time is written over the value of the volatile time-keeping mechanism stored at step (e).

9. A method for real-time data-stamping comprising the steps of:

a) providing an engine control module including a volatile time-keeping mechanism;

b) providing a non-volatile real-time clock;

c) providing a datalink coupling the engine control module to the real-time clock;

d) setting the volatile time-keeping mechanism to zero at power-up of the engine control module, such that the volatile time-keeping mechanism will measure time since power-up;

e) causing the engine control module to store measurement data together with a value of the volatile time-keeping mechanism;

f) causing the engine control module to retrieve current real-time from the real-time clock over the datalink prior to power-down of the engine control module;

g) causing the engine control module to store the current real-time and a corresponding current value of the volatile time-keeping mechanism, and h) wherein the real-time at which the measurement data was stored at step (e) may be calculated using the value of the volatile time-keeping mechanism stored with the measurement data, the current value of the volatile time-keeping mechanism, and the current real-time.

* * * * *